US011616317B2

(12) United States Patent
Anderson et al.

(10) Patent No.: US 11,616,317 B2
(45) Date of Patent: Mar. 28, 2023

(54) ANGLED POWER PIN ALIGNMENT AND CRIMPING FIXTURE

(71) Applicants: David Anderson, Avon, CO (US); Myles Keefer, Huntington Beach, CA (US); Larry Le, Long Beach, CA (US)

(72) Inventors: David Anderson, Avon, CO (US); Myles Keefer, Huntington Beach, CA (US); Larry Le, Long Beach, CA (US)

( * ) Notice: Subject to any disclaimer, the term of this patent is extended or adjusted under 35 U.S.C. 154(b) by 411 days.

(21) Appl. No.: 16/745,701

(22) Filed: Jan. 17, 2020

(65) Prior Publication Data

US 2020/0235513 A1 Jul. 23, 2020

Related U.S. Application Data

(60) Provisional application No. 62/794,166, filed on Jan. 18, 2019.

(51) Int. Cl.

| | |
|---|---|
| ***H01R 13/207*** | (2006.01) |
| ***E21B 43/12*** | (2006.01) |
| ***H01R 13/58*** | (2006.01) |
| ***H01R 43/28*** | (2006.01) |
| *H01R 13/533* | (2006.01) |

(52) U.S. Cl.

CPC ..... *H01R 13/207* (2013.01); *E21B 43/128* (2013.01); *H01R 13/5808* (2013.01); *H01R 43/28* (2013.01); *H01R 13/533* (2013.01)

(58) Field of Classification Search

CPC ..... H01R 13/207; H01R 13/5808; H01R 13/533; H01R 43/28; H01R 43/0421; E21B 43/128; Y10S 439/942

See application file for complete search history.

(56) References Cited

U.S. PATENT DOCUMENTS

| | | | | |
|---|---|---|---|---|
| 6,875,044 | B1 * | 4/2005 | Lee | H01R 4/2433 439/660 |
| 8,708,735 | B2 * | 4/2014 | Aime | H01R 31/02 439/510 |
| 10,326,215 | B1 * | 6/2019 | Anderson | H01R 43/0421 |
| 2021/0184405 | A1 * | 6/2021 | Ruffini | H01R 43/048 |

FOREIGN PATENT DOCUMENTS

| | | | | |
|---|---|---|---|---|
| EP | 3300187 | A1 * | 3/2018 | B25B 27/10 |

* cited by examiner

*Primary Examiner* — Travis S Chambers
(74) *Attorney, Agent, or Firm* — Dunlap Bennett & Ludwig, PLLC

(57) ABSTRACT

A power pin alignment and crimping fixture having a fixture body. The fixture body includes a plurality of channels each having a first open end and a second open end. The plurality of channels are disposed at an angle diverging away from one another in a direction from the first open end to the second open end such that each of the plurality of channels are disposed along a corresponding side edge of a symmetrical shape.

9 Claims, 5 Drawing Sheets

ANGLED POWER PIN ALIGNMENT AND CRIMPING FIXTURE

CROSS-REFERENCE TO RELATED APPLICATION

This application claims the benefit of priority of U.S. provisional application No. 62/794,166, filed Jan. 18, 2019, the contents of which are herein incorporated by reference.

BACKGROUND OF THE INVENTION

The present invention relates to a method and apparatus for crimping and, more particularly, to an angled power pin alignment and crimping fixture.

In the oil and gas industry, electrical submersible pumps are utilized to pump crude oil. In many cases, electrical connectors are attached to lengths of electrical submersible pump (ESP) cables and used to provide power to the pumps. Within the method of attaching the electrical connectors to the ESP cable, special pins are often attached, or crimped onto the electrically insulated conductors of the ESP cable. The position of the power pins after being crimped is critical to properly attach the ESP cable to the associated electrical connector. The conductors within ESP cables are typically heavy gauge, and therefore are very rigid conductors. Adequate separation of the conductors is also required in order to use the crimping tool.

Existing crimping fixtures which align the power pins and allow for the correct crimp to be made require the cable conductors to be stripped back a relatively long distance. A strip back is the length of which armor must be removed from the cable to expose the insulated electrical conductors. The reason for the long strip back is that the configuration of the existing crimping fixture requires the manipulation of the cable conductors such that they must be bent out first, then back into a parallel position. This manipulation of the insulated conductors increases the risk of damaging them which could potentially cause an electrical failure.

As can be seen, there is a need for an improved alignment and crimping fixture to decrease risk of damaging electrical submersible pump cables.

SUMMARY OF THE INVENTION

In one aspect of the present invention, a power pin alignment and crimping fixture comprises: a fixture body comprising a plurality of channels each having a first open end and a second open end, wherein the plurality of channels are disposed at an angle diverging away from one another in a direction from the first open end to the second open end such that each of the plurality of channels are disposed along a corresponding side edge of a symmetrical shape.

In another aspect of the present invention, a method of crimping conductors to power pins comprises steps of: providing a power pin alignment and crimping fixture comprising: a fixture body comprising a plurality of channels each having a first open end and a second open end, wherein the plurality of channels are disposed at an angle diverging away from one another in a direction from the first open end to the second open end such that each of the plurality of channels are disposed along a corresponding side edge of a symmetrical shape; placing a plurality of power pins into the plurality of channels so that a female end of the power pin is disposed at the first open end and a male end of the power pin is disposed at the second open end; stripping back armor and insulation, exposing a plurality of conductors of an electrical submersible pump cable; placing the plurality of conductors within the female ends of the plurality of power pins; and crimping the plurality of power pins to the plurality of conductors.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
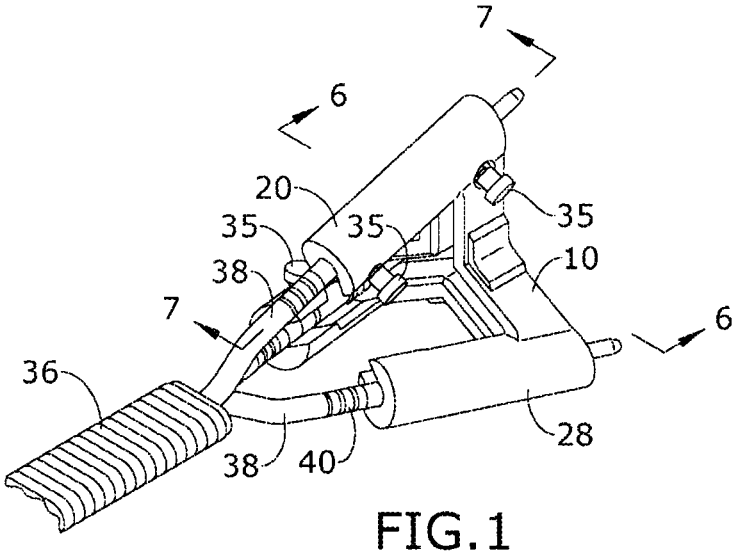
FIG. 1 is a perspective view of an embodiment of the present invention, shown in use.
Figure 2:
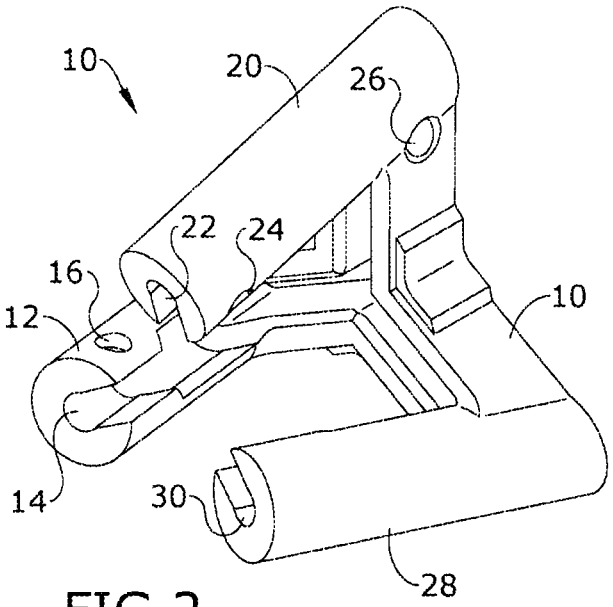
FIG. 2 is a top front perspective view of an embodiment of the present invention.
Figure 3:
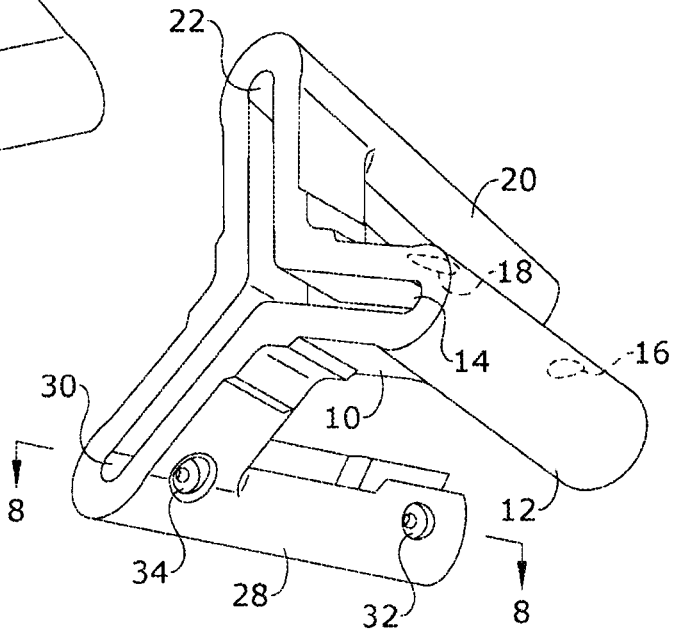
FIG. 3 is a bottom rear perspective view of an embodiment of the present invention.
Figure 4:
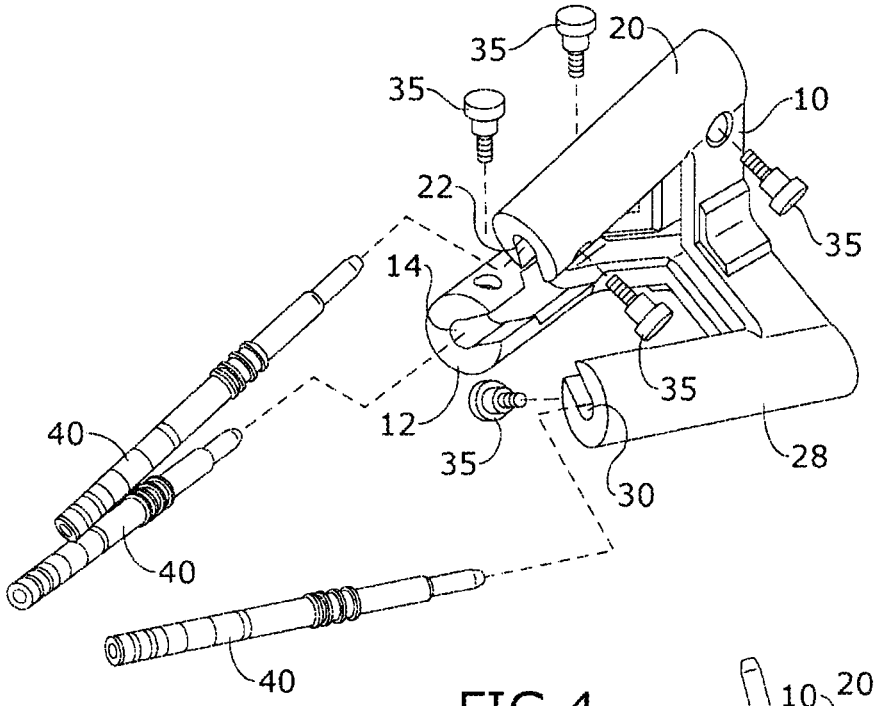
FIG. 4 is an exploded view of an embodiment of the present invention.
Figure 5:
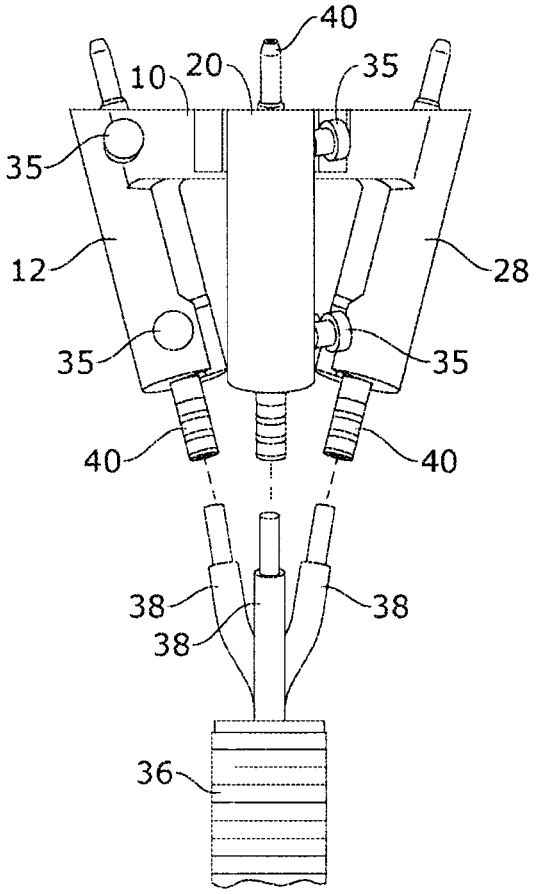
FIG. 5 is an exploded view of an embodiment of the present invention.
Figure 6:
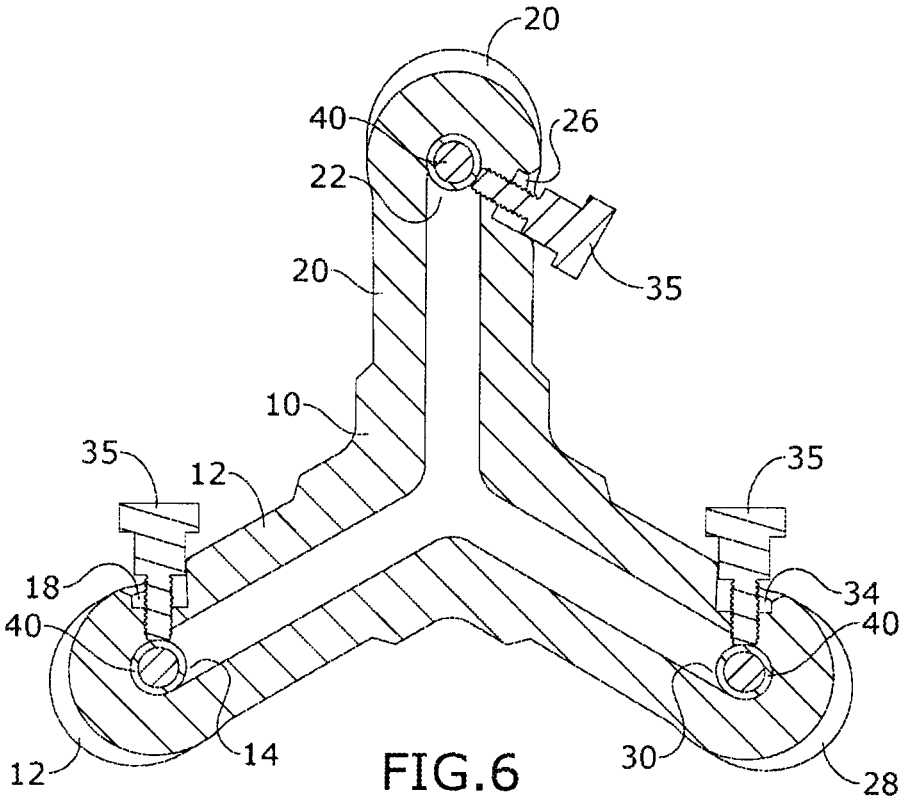
FIG. 6 is a section view of the present invention, taken along line 6-6 in FIG. 1.
Figure 7:
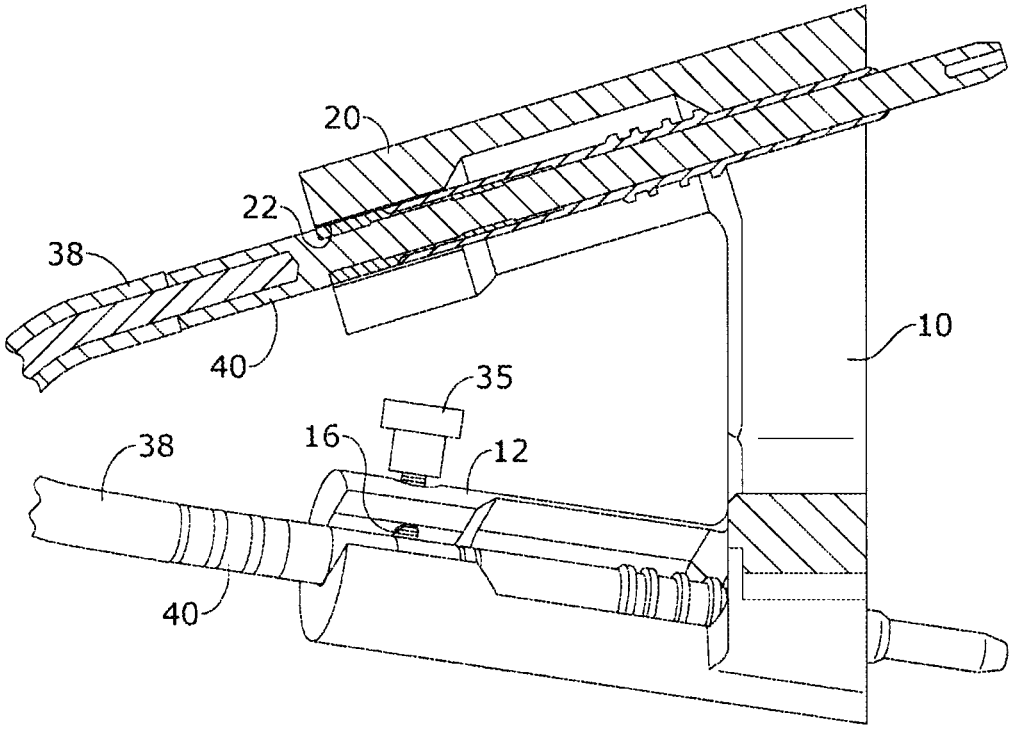
FIG. 7 is a section view of the present invention, taken along line 7-7 in FIG. 1.
Figure 8:
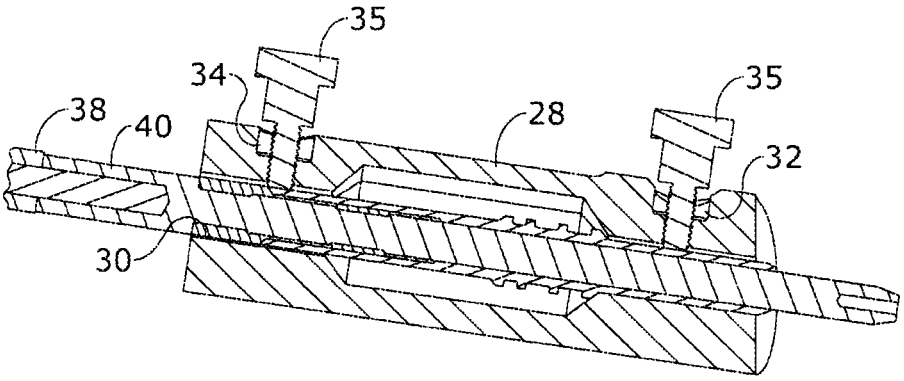
FIG. 8 is a section view of the present invention, taken along line 8-8 in FIG. 3.
Figure 9:
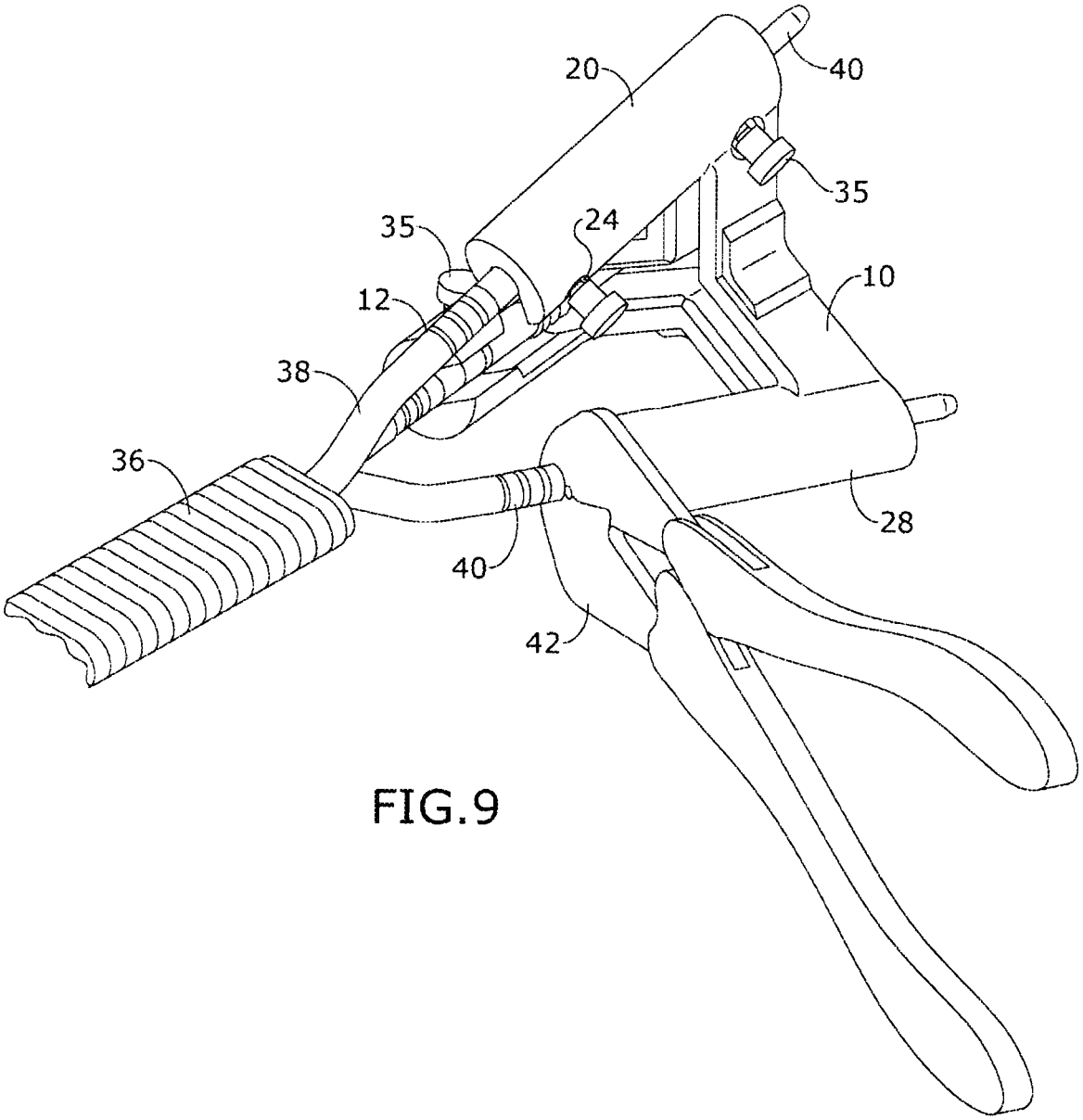
FIG. 9 is a perspective view of an embodiment of the present invention, shown in use.

Referring to FIGS. 1 through 9, the present invention includes a power pin alignment and crimping fixture having a fixture body 10. The fixture body 10 includes a plurality of channels 14, 22, 30 each having a first open end and a second open end. The plurality of channels 14, 22, 30 are disposed at an angle diverging away from one another in a direction from the first open end to the second open end such that each of the plurality of channels 14, 22, 30 are disposed along a corresponding side edge of a symmetrical shape.

The fixture body 10 of the present invention may include a plurality of fixture arms 12, 20, 28 and a base 11 coupling the plurality of fixture arms 12, 20, 28 together. The plurality of channels 14, 22, 30 run through the plurality of fixture arms 12, 20, 28. In certain embodiments, the present invention may include three fixture arms 12, 20, 28 including a first fixture arm 12, a second fixture arm 20, and a third fixture arm 28. The first fixture arm 12 includes a first channel 14, the second fixture arm 20 includes a second channel 22, and a third fixture arm 28 includes a third channel 30. In such embodiments, the three channels 14, 22, 30 are disposed along a corresponding side edge of a three sided symmetrical shape.

In certain embodiments, set screws may be used to secure power pins 40 within the channels 14, 22, 30. For example, the first fixture arm 12 may include a first threaded slot 16 and a second threaded slot 18 each running from a side of the first fixture arm 12 to the first channel 14. The second fixture arm 20 may include a first threaded slot 24 and a second threaded slot 26 each running from a side of the second fixture arm 20 to the second channel 22. The third fixture arm 28 may include a first threaded slot 32 and a second threaded slot 34 each running from a side of the third fixture arm 28 to the third channel 30. Set screws may be driven through the threaded slots and press against the power pins 40, thereby securing power pins 40 within corresponding channels 14, 22, 30.

The present invention further includes a method of crimping electrically insulated conductors 38 to power pins 40. The method includes providing the power pin alignment and crimping fixture described above. Place a power pin 40 and power pin sleeve within each of the channels 14, 22, 30 so that female ends of the power pins 40 are disposed at the first open ends and male ends of the power pins 40 are disposed at the second open ends. Secure the plurality of power pins 40 within the plurality of channels 14, 22, 30 by tightening the set screws. Strip back armor 36 to expose a plurality of conductors 38 of an electrical submersible pump cable. Place the plurality of conductors 38 within the female ends of the plurality of power pins 40. Once securely placed into position, the crimping fixture creates adequate spacing for a crimping tool 42 while fixing each power pin 40 in position. Crimp the plurality of power pins 40 to the plurality of conductors 38 using the crimping tool 42. Loosen the set screws and remove a plurality of crimped conductors and power pins from the power pin alignment and crimping fixture. After each crimped conductors and power pins are removed from the crimping fixture, each power pin is now properly crimped to the ESP Cable in the correct position and can be used to attach the associated electrical connector.

This new unique crimping tool positions the conductors 38 and power pins 40 at an angle such that the cable conductors 38 do not need to be bent back into parallel position, thus decreasing the manipulation of the cable conductors 38 and the risk causing damage to the electrical insulation or ultimately an electrical failure. By securing the insulated conductors 38 in an angular position, the crimping fixture significantly reduces the length of which the armor 36 is required to be stripped back. The reduction in length of armor 36 removal, effectively reduces the length requirement of the associated connector. Reducing the length of the connector significantly improves the variety of oil wells the connector can now be placed into. The angle of the crimping fixture allows for enough spacing between the conductors 38 to allow for standard crimping tools 40 to be used to crimp power pins 40 to the conductors 38.

It should be understood, of course, that the foregoing relates to exemplary embodiments of the invention and that modifications may be made without departing from the spirit and scope of the invention as set forth in the following claims.

What is claimed is:

1. A power pin alignment and crimping fixture comprising:

a fixture body comprising a plurality of channels each having a first open end and a second open end, wherein the plurality of channels are disposed at an angle diverging away from one another in a direction from the first open end to the second open end such that each of the plurality of channels are disposed along a corresponding side edge of a symmetrical shape, wherein the fixture body comprises a plurality of fixture arms and a base coupling the plurality of fixture arms together, wherein the plurality of channels run through the plurality of fixture arms.

2. The power pin alignment and crimping fixture of claim 1, wherein the plurality of channels is three channels and the symmetrical shape is a three sided symmetrical shape.

3. The power pin alignment and crimping fixture of claim 1, wherein each of the plurality of fixture arms comprise at least one threaded slot running from a side of the fixture arm to the channel, and a set screw disposed within the at least one threaded slot.

4. The power pin alignment and crimping fixture of claim 3, wherein the at least one threaded slot is a first threaded slot and a second threaded slot.

5. A method of crimping electrically insulated conductors to power pins comprising steps of:

providing a power pin alignment and crimping fixture comprising:

a fixture body comprising a plurality of channels each having a first open end and a second open end, wherein the plurality of channels are disposed at an angle diverging away from one another in a direction from the first open end to the second open end such that each of the plurality of channels are disposed along a corresponding side edge of a symmetrical shape;

placing a plurality of power pins into the plurality of channels so that a female end of the power pin is disposed at the first open end and a male end of the power pin is disposed at the second open end;

stripping back armor and exposing a plurality of electrically insulated conductors of an electrical submersible pump cable;

placing the plurality of conductors within the female ends of the plurality of power pins; and crimping the plurality of power pins to the plurality of conductors.

6. The method of claim 5, wherein the fixture body comprises a plurality of fixture arms and a base coupling the plurality of fixture arms together, wherein the plurality of channels run through the plurality of fixture arms.

7. The method of claim 6, wherein each of the plurality of fixture arms comprise at least one threaded slot running from a side of the fixture arm to the channel, and a set screw disposed within the at least one threaded slot.

8. The method of claim 7, further comprising a step of:

securing the plurality of power pins within the plurality of channels by tightening the set screws.

9. The method of claim 8, further comprising steps of loosening the set screws after the step of crimping the plurality of power pins to the plurality of electrically insulated conductors; and removing a plurality of crimped conductors and power pins from the power pin alignment and crimping fixture.

* * * * *